United States Patent [19]

Rodrique

[11] 4,152,836

[45] May 8, 1979

[54] MEASUREMENT LINE MARKER

[76] Inventor: Marcel Rodrique, Rong 6 Courcelles, Conté Frontenac, Quebec, Canada

[21] Appl. No.: 863,112

[22] Filed: Dec. 22, 1977

[51] Int. Cl.[2] ..... B44D 3/38

[52] U.S. Cl. ..... 33/87

[58] Field of Search ..... 33/87, 137 R

[56] References Cited

U.S. PATENT DOCUMENTS

| | | | |
|---|---|---|---|
| 1,838,383 | 12/1931 | Fridolph | 33/87 X |
| 2,133,237 | 10/1938 | Slayter | 33/137 R |
| 2,602,233 | 7/1952 | Irving | 33/137 R |

FOREIGN PATENT DOCUMENTS

| | | | |
|---|---|---|---|
| 1026051 | 4/1966 | United Kingdom | 33/87 |

*Primary Examiner*—Charles E. Phillips

*Attorney, Agent, or Firm*—Thomas L. Tully

[57] ABSTRACT

A measurement line marker for the placement of a multiplicity of visible marks on a surface, which marks are accurately spaced from each other by any desired distance, such as sixteen inches on center, and which are located in a straight line so as to provide position marks, such as for the location of studs or other building materials. The marker comprises a thin non-stretchable flexible metal wire, a flexible plastic sleeve thereover having a uniform thickness and having a smooth, non-receptive surface, and a multiplicity of narrow receptive sleeve segments which are spaced from each other by any desired predetermined distances, said segments having a thickness approximately the same as said flexible sleeve and being porous and selectively receptive to marking chalk.

6 Claims, 4 Drawing Figures

MEASUREMENT LINE MARKER

BACKGROUND OF THE INVENTION

In the construction trade and in related fields, it is a constant requirement to position studs, posts, walls, partitions, beams, bolts and a variety of other building materials at predetermined and accurate distances from each other and in a straight line or coplanar to each other.

This requirement is generally satisfied by two separate operations employing two separate devices. Generally, the first step is to provide a straight line and this is accomplished by means of a conventional chalk string which is a length of chalk-receptive string contained on a spool within a casing and removable through a small eyelet or opening in the casing. The string is drawn out of the casing through the eyelet and against a piece of marking chalk, the chalk particles becoming trapped within the porous body of the string. The chalked string is fastened adjacent the surface to be marked, such as a floor, and is snapped against the surface to transfer some of the chalk to the surface to provide a straight chalk line on the surface corresponding, for instance, to the path of a wall to be constructed.

The next step employs a measuring device, such as a folding wooden ruler or a flexible, retractable metallic measuring tape. The measuring device is aligned with the chalk line and additional chalk marks are applied manually to the surface to indicate predetermined, accurately-spaced distances along the chalk line. In the case of wall studs, such marks generally are spaced from each other by exactly sixteen inches. A carpenter relies upon the manually-applied marks to indicate, for instance, the relative positions of studs which he erects as a support for a straight wall.

It has been proposed to combine both of these steps by applying over the chalk string a number of spaced narrow applications of paint to render said narrow spaced areas non-receptive to the marking chalk. Such a chalk string provides a continuous chalk line which is interrupted by narrow voids which are spaced from each other by predetermined distances. The disadvantages of such chalk strings are manifold. Firstly, such strings do not provide reliably-spaced indicia because the length of a string will vary to some extent with changes in temperature and humidity; string increases in length or stretches when under tension, and string increases in length and becomes weak after prolonged use. Secondly, such chalk strings provide narrow spaced voids or chalkfree areas which are difficult to locate along the chalk line unless they are fairly wide, in which case they do not provide an accurate measurement guide. Also, if the chalk line is weak in intensity and/or is inadvertently contacted, voids may appear in unintended areas to mislead the carpenter. In other words, a positive mark is more reliable than the absence of a mark. Furthermore, paint or other materials applied to the string surface can wear off, particularly under the effects of repeated transport of the string through the narrow eyelet provided on most casings.

SUMMARY OF THE INVENTION

The present invention relates to a measurement line marker which satisfies a long felt need in the construction industry and which is devoid of the disadvantages of measuring lines proposed in the past. The present line markers consist of a thin flexible metal wire core, which is dimension stable, a thin, smooth, flexible, non-receptive coating or sleeve having a uniform thickness covering the major portion of the length of said wire core, and a multiplicity of narrow, spaced, porous receptive sleeve segments, said segments having a thickness approximately the same as the flexible sleeve so as not to extend substantially thereabove and not to present an obstacle to the removal or retraction of the line marker through the narrow eyelet on the casing.

DESCRIPTION OF THE PREFERRED EMBODIMENTS

Figure 1:
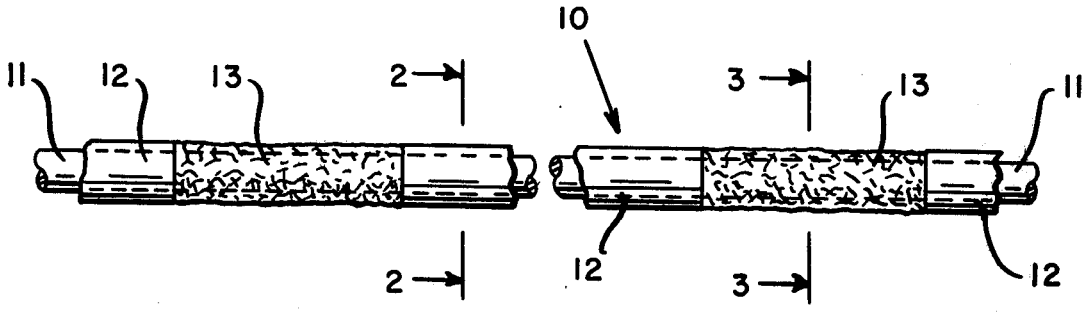
FIG. 1 is a fragmentary view, to an enlarged scale, of a measurement line marker according to an embodiment of the present invention.
Figure 2:
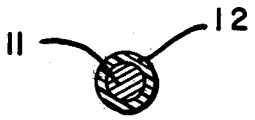
FIG. 2 is a cross-sectional view of the marker of FIG. 1, taken along the line 2—2 thereof.
Figure 3:
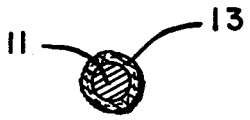
FIG. 3 is a cross-sectional view of the marker of FIG. 1, taken along the line 3—3 thereof.

The measurement line markers 10 of the present invention comprise a continuous length of a flexible thin wire 11, such as copper or steel having a diameter of from about 1/32 inch to about 1/16 inch for example, a thin coating, casing or sleeve comprising long segments 12 of a smooth plastic which is not receptive to or retentive of marking chalk to any substantial extent and which has a uniform thickness equal to, for example, from about ½ up to about twice the diameter of the wirecore, as shown by FIG. 2. The smooth plastic sleeve segments 12 are spaced from each other along the length of the marker with a multiplicity of narrow porous sleeve segments 13 which are receptive to and retentive of marking chalk to a substantial extent and which are bonded to the wire core 11, as shown by FIG. 3, and have a thickness which is approximately the same as that of the long plastic sleeve segments 12. The segments 13 are spaced from each other by predetermined accurate distances, which distances do not change to any important extent with changes in humidity or temperature or under tension or wear, since the wire core material 11 is stable and non-stretching and since the porous material 13 is integral with the plastic sleeve segments 12 and/or inlaid therebetween against the core 11 so as to negate movement or removal of segments 13 relative to sleeve 12 and core 11.

Figure 4:
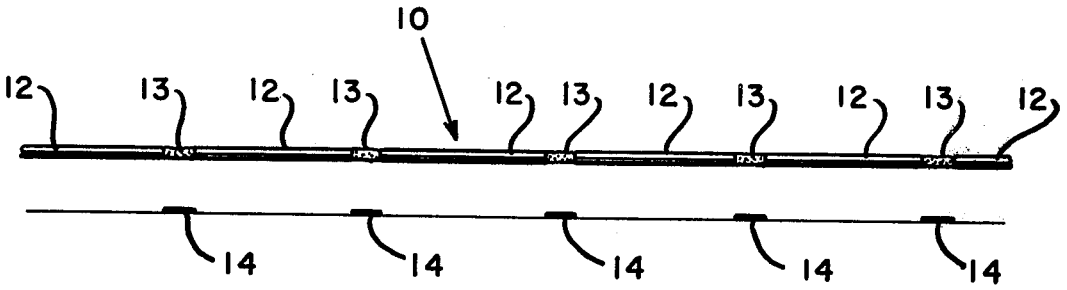
FIG. 4 is a fragmentary view of a measurement line marker, according to the present invention, aligned with and spaced from a surface carrying spaced chalk marks produced by said line marker.

When the marker wire 10 is withdrawn from its spool within its casing through the narrow eyelet which has a diameter slightly larger than the diameter of the marker wire 10, there are no portions of the marker wire 10 having a substantially greater thickness than the remainder of the marker wire and, therefore, the marker wire can be withdrawn and retracted witout snagging or wearing. When the marker wire 10 is withdrawn from its casing for use, it is drawn across a piece of marking chalk. The plastic sleeve 12, such as of polyethylene, polypropylene, polyvinyl chloride, or the like, has a smooth surface which does not cut into or absorb or hold the chalk and pick up and absorb substantial portions of the powdered chalk. When the chalked wire 10 is placed in tension adjacent a surface to be marked and is snapped against that surface, the chalked segments 13 transfer portions of the powdered chalk loosely held thereby to the surface to be marked, forming chalk marks 14 thereon which are aligned in a straight line and which are uniformly and accurately spaced from each other, as shown by FIG. 4.

Preferably, the segments 13 consist of inlays of fabric which are wound around the wire 11 in spaced areas from which narrow segments of the plastic sleeve 12 have been removed. The fabric may be cotton, wool, felt or other porous material which is wound around the wire and glued thereto in the form of a narrow strip or as a string. The width of the segments 13 may be varied depending upon the precision of the measurements required. Generally, for carpentry work, such segments will range between about ¼ inch to 1 inch in width, the spacing of the segments being measured from the center of each.

Alternatively, the segments 13 may be produced by roughening the surface of the plastic sleeve 12 at the narrow spaced intervals to render it rough and porous and receptive to the marking chalk. For instance, the plastic sleeve 12 may be formed of plastic composition containing a pore-forming material, such as solvent-removable salt particles or a heat-activatable blowing agent so that the sleeve can be treated at the narrow spaced intervals to dissolve the salt or activate the blowing agent and render said narrow areas rough, porous and receptive to the marking chalk.

Variations and modifications of the embodiments disclosed herein will be apparent to those skilled in the art, within the scope of the following claims.

I claim:

1. A measurement line marker which is substantially resistant to changes in length under the effects of changes in tension, temperature and humidity, said marker comprising a continuous length of a thin, flexible, non-stretchable metal wire and a flexible thin sleeve covering said wire, said sleeve comprising a multiplicity of long sleeve segments of plastic material having a thickness which extends outwardly from said wire and has a smooth surface which is substantially non-receptive to marking chalk, and a multiplicity of short sleeve segments having a thickness which extends outwardly from said wire, one each located between two of said long sleeve segments and being separated from each other by predetermined fixed distances, each of said long and short sleeve segments being attached to said wire to negate movement thereof relative to each other or relative to said wire and to negate removal of said segments from said wire, said short sleeve segments having porous surfaces which are receptive to marking chalk whereby when a solid piece of marking chalk is abraded by said measurement line marker portions of said chalk are selectively adhered to said narrow porous sleeve segments and repelled by said long smooth plastic sleeve segments to provide a chalked line marker capable of producing a multiplicity of aligned, accurately spaced narrow chalk marks on a surface.

2. A marker according to claim 1 in which said narrow sleeve segments have a thickness which is substantially the same as the thickness of said long sleeve segments.

3. A marker according to claim 1 in which said narrow sleeve segments comprise a porous fabric which is bonded to said wire.

4. A marker according to claim 3 in which said porous fabric comprises a narrow strip of cotton which is wound around said wire.

5. A marker according to claim 1 in which said wire has a thickness of from about 1/32 inch to about 1/16 inch and said long plastic sleeve segments have a thickness when is equal to from about ½ up to about twice the thickness of said wire.

6. A marker according to claim 1 in which said narrow porous sleeve segments have a length which is from about ¼ inch to about 1 inch in length.

* * * * *